United States Patent [19]

Galdal

[11] 4,047,720

[45] Sept. 13, 1977

[54] GAME INCLUDING NOVEL BOARD AND PLAY PIECES

[76] Inventor: Jon S. Galdal, 140 Highland Ave., Edison, N.J. 08817

[21] Appl. No.: 698,061

[22] Filed: July 8, 1976

[51] Int. Cl.[2] ..... A63F 3/00

[52] U.S. Cl. ..... 273/130 R; 273/137 AD

[58] Field of Search ..... 273/130 R, 131 KP, 131 BA, 273/136 C, 136 E, 137 AL, 137 AD

[56] References Cited

U.S. PATENT DOCUMENTS

| | | | |
|---|---|---|---|
| 2,280,609 | 4/1942 | Williamson | 273/157 R |
| 3,376,042 | 4/1968 | Dunlap | 273/136 C |
| 3,402,934 | 9/1968 | Adams | 273/136 E |
| 3,404,890 | 10/1968 | Christy | 273/130 R |
| 3,695,616 | 10/1972 | Weber | 273/130 R |
| 3,804,415 | 4/1974 | Ryan | 273/130 R |

*Primary Examiner*—Anton O. Oechsle
*Assistant Examiner*—Arthur S. Rose

[57] ABSTRACT

The game includes a board having a plurality of holes, pins, or the like, which are disposed in a start area, a play area, and a scoring area. The game also includes a set of play pieces for each player, and each play piece includes means by which it can be coupled to the board. The play pieces include pieces of different length, so that they can span different lengths in the play area, and pieces of different heights or other characteristics which are usable by one player to block pieces of another player.

4 Claims, 9 Drawing Figures

Fig. 1
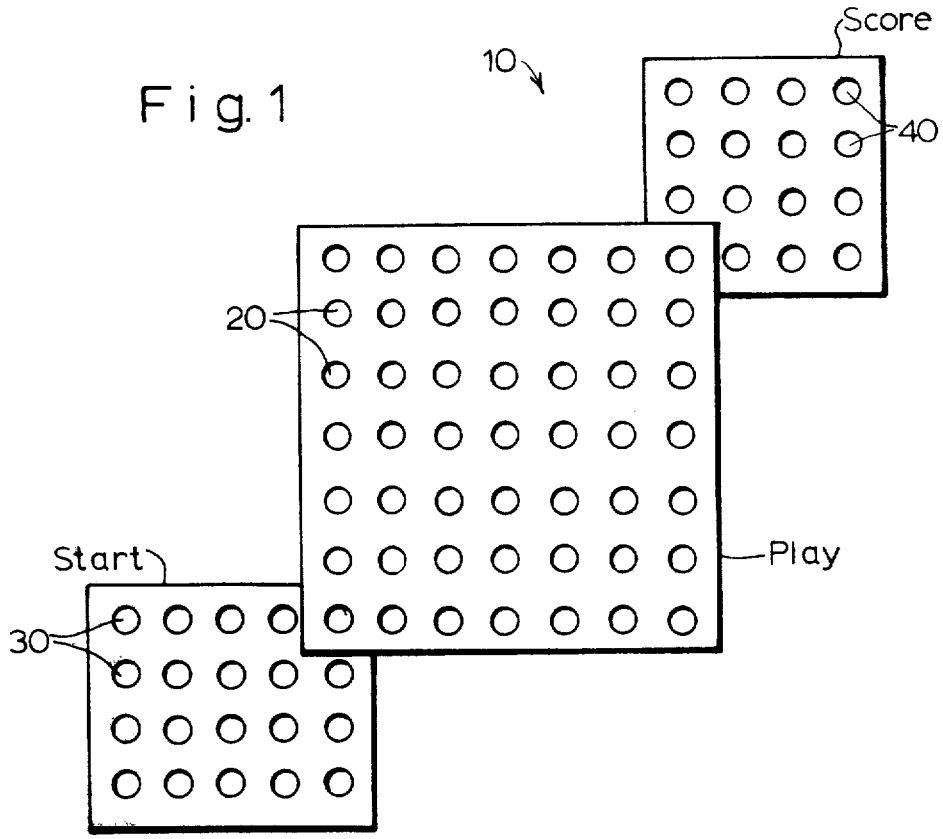
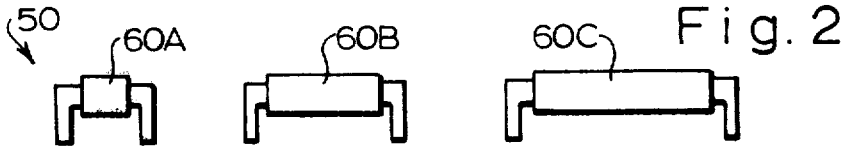
Fig. 2
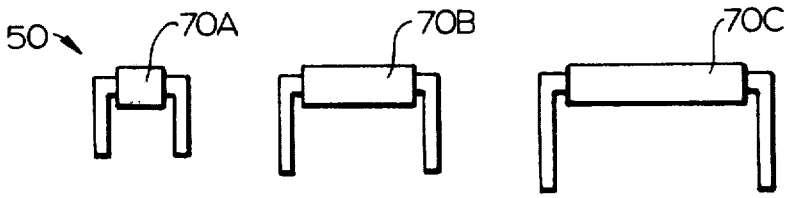
Fig. 3
Fig. 4
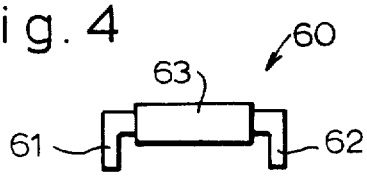
Fig. 5
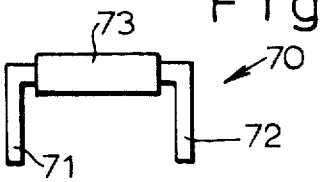

Fig. 6
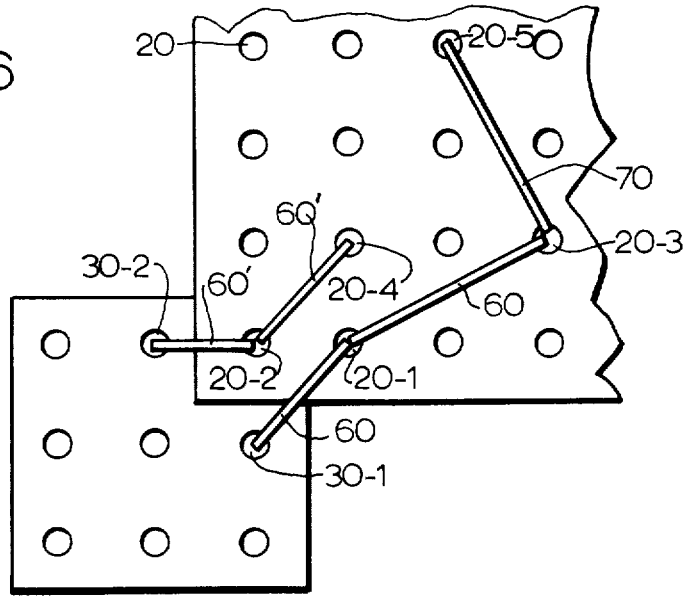
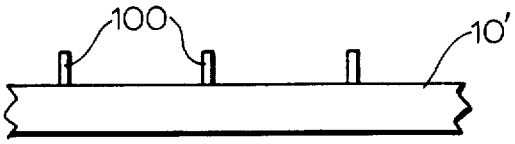
Fig. 7
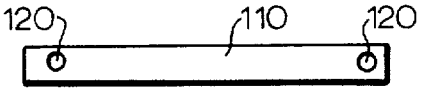
Fig. 8
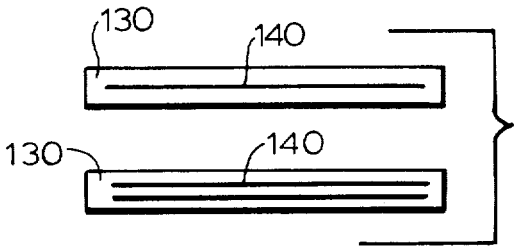
Fig. 9

GAME INCLUDING NOVEL BOARD AND PLAY PIECES

BACKGROUND OF THE INVENTION

Games which comprise game boards and playing pieces are well known. However, such a game is not known in the prior art which includes play pieces of such structural and operational variety as the pieces described and shown herein.

DESCRIPTION OF THE DRAWINGS

FIG. 1 is a plan view of one form of game board used in the invention;

FIG. 2 is a side elevational view of play pieces of different length;

FIG. 3 is a side elevational view of play pieces of different height;

FIG. 4 is an enlarged side elevational view of a play piece;

FIG. 5 is an enlarged side elevational view of another play piece.

FIG. 6 is an enlarged view of a portion of the game board of FIG. 1 and play pieces thereon to illustrate one mode of playing the game.

FIG. 7 is a side elevational view of a portion of a modification of the game board of the invention;

FIG. 8 is a plan view of a play piece usable with the board of FIG. 7; and

FIG. 9 is a plan view of modified play pieces of the invention.

DESCRIPTION OF THE PREFERRED EMBODIMENTS

The game of the invention includes a board 10 of wood, plastic, cardboard, metal or any suitable material, having a first group of holes 20 disposed in rows and columns, or the like, and representing the play area of the game, a second group of holes 30 at a suitable location at which play is begun, and another group of holes 40 located, remote from the second group, at which scoring takes place.

The game includes a set 50 of play pieces for each player (FIGS. 2 and 3), and each set includes a plurality of generally U-shaped pieces of different lengths 60 A, B, C (FIGS. 2 and 4), each piece including two legs 61, 62 and a connecting portion 63. The pieces are of different lengths so that the legs 61, 62 can be inserted in adjacent holes, or holes which are spaced apart different distances. In addition, each set of play pieces includes generally U-shaped pieces 70 A, B, C (FIGS. 3 and 5) of different heights, each including legs 71, 72 and a connecting portion 73.

The game is played, in one mode, by the players taking turns, with each player beginning the game by selecting a desired game piece 60 or 70, and, with one leg inserted in a hole 30 in the start area of the board, he places the other leg in a suitable hole 20 in the play area. The next player performs the same operation, as does each other player in turn. The players generally, as they take their turns, use their pieces to move in the direction of the holes 40 in scoring area, which, when entered, permit the player to add a point to his score. As the players take their turns, they use their play pieces of different lengths and different heights to block other players in their moves. In addition, a player can use his pieces of different length and height to get around or to jump over an opponent's pieces.

A typical series of play steps is illustrated in FIG. 6 wherein the first player connects a play piece 60 from a hole 30-1 to a hole 20-1, and the second player connects a play piece 60' from a hole 30-2 to a hole 20-2. Next, the first player, assuming that there are only two, connects a longer piece 60 between the hole 20-1 to a second hole 20-3, and the second player connects a piece 60' from the first hole 20-2 to the second hole 20-4. At this time, the first player connects a higher piece 70 between the second hole 20-3 to a third hole 20-5 to thus block the path of the second player who must now follow a more devious route to the scoring area with his various play pieces.

It can be seen that substantially any desired number of players may play, the number and size of play pieces in each set is unlimited, and the size and orientation of the play board are also unlimited, all of course within reason and utility.

Various modifications may also be made in the mechanical aspects of the game. For example, instead of having holes, the game board 10' (FIG. 7) may be provided with pins 100, and the play pieces 110 (FIG. 8) may have apertured tabs 120 at their ends which can be threaded on the pins 100. In addition, instead of, or in addition to, using pieces of different height to serve a blocking function, pieces having other description may be used. For example, a piece of a particular color may be given a certain blocking value, pieces 130 (FIG. 9) may have different numbers of stripes 140 formed on them, or other comparable arrangements may be used.

What is claimed is:

1. Game apparatus comprising a game board having means for receiving play pieces, said board including: means defining a starting area on said board, means defining a play area distinct from said starting area on said game board, and means defining a scoring area on said game board distinct from said starting and play areas, and a set of play pieces for each player, each set of play pieces including pieces having different blocking values, due to their mechanical configuration, with respect to pieces of another set, said play pieces being generally U-shaped and having different lengths and different heights.

2. The apparatus defined in claim 1 wherein said game board includes a plurality of holes in said various areas and said play pieces include means for engaging said holes.

3. The apparatus defined in claim 2 wherein said play pieces include legs which can engage said holes in said game board.

4. The apparatus defined in claim 1 wherein said play pieces include pieces of different lengths and pieces having mechanical structural features which impart different blocking characteristics thereto.

* * * * *